United States Patent [19]

O'Gara

[11] Patent Number: 4,765,165

[45] Date of Patent: Aug. 23, 1988

[54] LOCK/PLATE ASSEMBLY, ESPECIALLY AS A REPLACEMENT IN CAR DOORS

[76] Inventor: James O'Gara, 444 W. 258th St., Riverdale, N.Y. 10471

[21] Appl. No.: 50,918

[22] Filed: May 15, 1987

[51] Int. Cl.[4] ..... E05B 63/00

[52] U.S. Cl. ..... 70/417; 70/451; 70/452

[58] Field of Search ..... 70/381, 451, 452, 417, 70/370

[56] References Cited

U.S. PATENT DOCUMENTS

| | | | |
|---|---|---|---|
| 4,041,741 | 8/1977 | Cintra | 70/417 |
| 4,129,020 | 12/1978 | Gonzelez | 70/417 |
| 4,139,999 | 2/1979 | Allenbaugh | 70/452 |
| 4,160,368 | 7/1979 | Solow | 70/417 |
| 4,619,123 | 10/1986 | Hill | 70/417 |

*Primary Examiner*—Robert L. Wolfe
*Attorney, Agent, or Firm*—Herbert Dubno

[57] ABSTRACT

A supporting surface is formed with a cylinder hole, a cover plate is provided with a bulge having a keyhole formed in registration with the cylinder hole, in which there is disposed the noncircular outlined shank of a lock cylinder, the lock cylinder having a head disposed in the bulge. A holding plate formed with a noncircular opening in registration with the cylinder hole and complementary to the noncircular shank outline is in engagement therewith for preventing rotation of the lock cylinder, while a plurality of bores are formed in respective mutual alignment in the cover plate, supporting surface, and holding plate whereby, respective fastening means traverse the aligned bores for mounting the lock plate assembly on the supporting surface with at least the cover plate on the outer side thereof.

20 Claims, 3 Drawing Sheets

LOCK/PLATE ASSEMBLY, ESPECIALLY AS A REPLACEMENT IN CAR DOORS

FIELD OF THE INVENTION

The present invention relates, in general, to lock plate assemblies adapted to be mounted on a supporting surface formed with a cylinder hole, and, more particularly, to lock plate assemblies used as replacements in car doors which have sustained forced entry.

BACKGROUND OF THE INVENTION

Normally, car door locks comprise a noncircular cylinder opening provided in an outer door panel in which the complementary noncircular outlined shank of a lock cylinder is disposed and held against rotation, while a clip on the inside of the door panel engages projections on the shank to prevent removal of the lock cylinder from the door.

When a car is broken into, the usual method is to rip the lock cylinder out of the door panel, thereby giving direct access to the lock mechanism, leaving the cylinder opening torn and unable to hold a lock cylinder. If the damage is not too great, the cylinder opening can be repaired by hammering the torn fragments back into place and welding the tears but at best, leaving a door which usually leaks water and is weakened and not as secure as it was prior to the forced entry. If the damage is too great, the entire car door must be replaced.

OBJECTS OF THE INVENTION

It is therefore an object of the present invention to provide an improved repair system to obviate the aforementioned drawbacks.

It is another object of the invention to provide a lock plate assembly for a car door having sustained forced entry which will be as secure or securer than the original equipment.

It is a further object of the invention to provide a lock plate assembly which will not leak water.

SUMMARY OF THE INVENTION

The above and other objects are attained in a lock plate assembly adapted to be mounted on a supporting surface formed with a cylinder hole, in this case a car door which has sustained forced entry, leaving the cylinder hole damaged and useless, the assembly having a cover plate provided with a bulge having a keyhole formed in registration with the cylinder hole, in which there is disposed the noncircular outlined shank of a lock cylinder, the lock cylinder having a head disposed in the bulge. A holding plate formed with a noncircular opening in registration with the cylinder hole and complementary to the noncircular shank outline is in engagement therewith for preventing rotation of the lock cylinder, while a plurality of bores are formed in respective mutual alignment in the cover plate, supporting surface, and holding plate whereby, respective fastening means traverse the aligned bores for mounting the lock plate assembly on the supporting surface with at least the cover plate on an outer side thereof.

In making a repair, the plurality of bores are formed in the door panel around the damaged cylinder hole so that they are in mutual alignment with the bores of the cover plate and holding plate.

In a first method of repair, the holding plate is placed on the outer side of the door panel with the bores thereof in alignment with those formed in the panel and the lock cylinder is inserted into the noncylindrical opening of the holding plate, the cover plate then being placed over the cylinder head and against the holding plate with the bores in mutual alignment. The fastening means is then used to mount the lock plate assembly on the door panel.

In an alternative method of repair, the holding plate can be placed on the inner side of the door panel following the same steps as the first method.

In another feature of the invention, the plates can be provided with a synthetic resin layer on the surface of the plate directed toward the door panel to act as a watertight seal against rain and car washing.

In another embodiment of the invention in which the holding plate will be mounted on the outer side of the door panel, but it is still desired to have a plate mounted on the inner side of the panel, a backing plate is provided formed with a C-shaped slot defining a pair of arms which will flank the shank of the lock cylinder. In a unique feature of this holding plate, the plate can be placed on the inner side of the panel by inserting from the front side of the panel an arm of the plate into the cylinder hole and rotating the plate so that the other arm can be brought through the cylinder hole and the bores of this holding plate then brought into alignment with those of the door panel. To aid in the placement of the holding plate, the surface thereof facing the door panel can be provided with an adhesive coating, as well as can all of the plates to aid in their placement.

BRIEF DESCRIPTION OF THE DRAWING

The above and other objects, features and advantages of the invention will become more readily apparent from the following description, reference being made to the accompanying drawing, in which.

SPECIFIC DESCRIPTION

Figure 1:
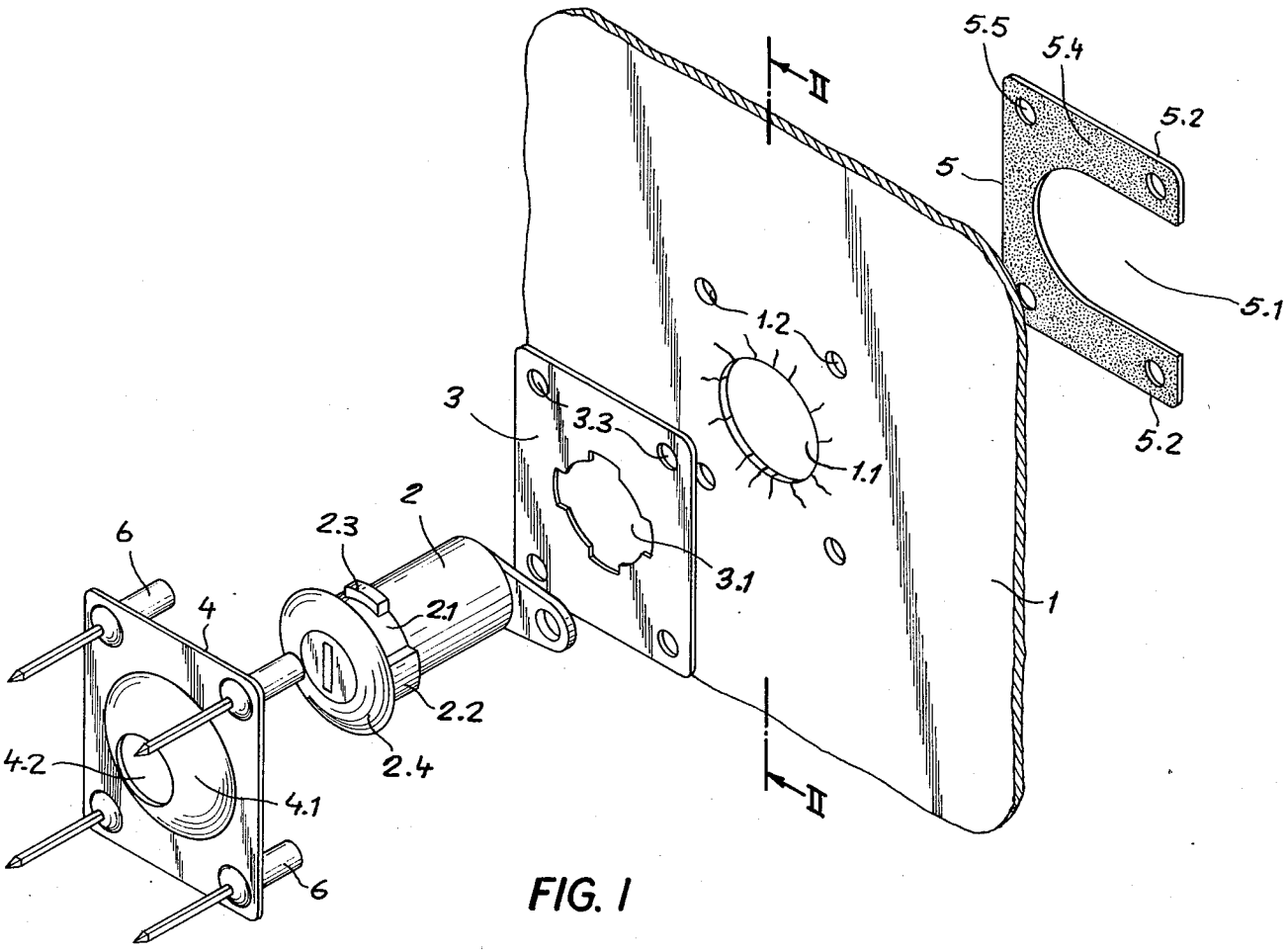
FIG. 1 is an exploded perspective view of a lock/-plate assembly according to the invention.
Figure 2:
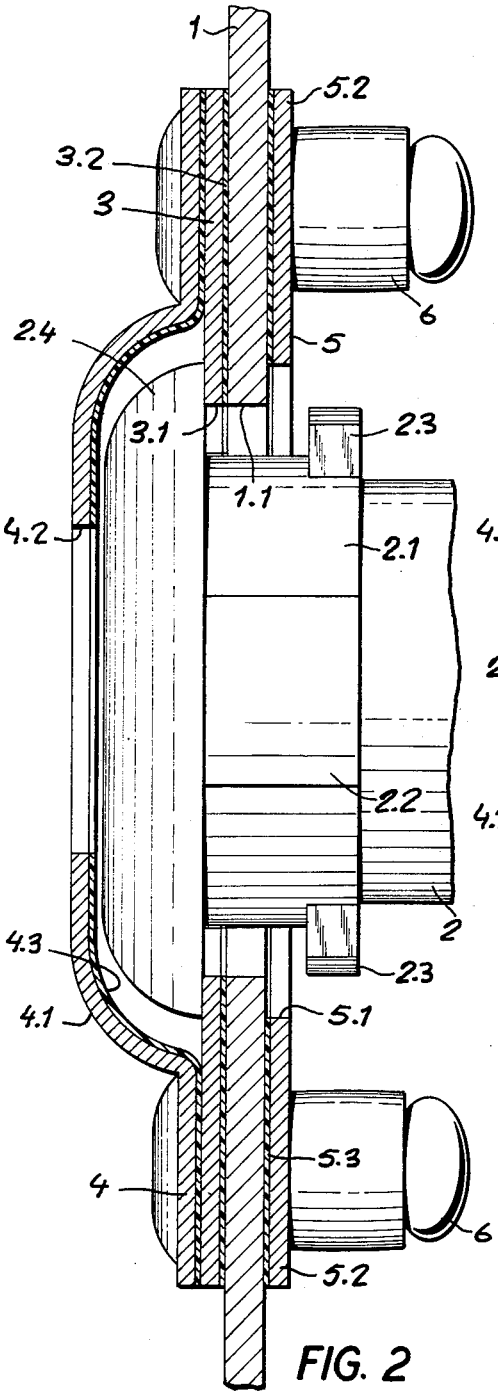
FIG. 2 is a sectional view taken along line II—II of FIG. 1 of the lock/plate assembly in an assembled condition.

The entire lock/plate assembly according to a first embodiment of the invention is illustrated in FIGS. 1 and 2, which show a portion of a car door panel 1 in which the cylinder hole 1.1 has been damaged by having the lock cylinder ripped out during a forced entry.

A replacement lock cylinder 2 has a shank portion 2.1 which is disposed in the cylinder hole 1.1 and is formed with ribs 2.2 and projections 2.3, which lie on the inner side of the door panel 1 and normally coact with a clip against the panel 1 to hold the lock cylinder 2 with the head 2.4 thereof against the outer side of the panel 1, but which is dispensed with here since it is not needed.

In this embodiment, the head 2.4 rests against a holding plate 3 formed with a notched opening 3.1 in registration with cylinder hole 1.1 and complementary to the passage of projections 2.3 and ribs 2.2, which are engaged by the notched opening 3.1 to prevent rotation of the lock cylinder 2. The holding plate 3 is further provided with a synthetic resin layer 3.2 which abuts the outer side of panel 1 to form a watertight seal therewith.

A cover plate 4 is provided with a bulge 4.1 formed with a keyhole 4.2 in registration with cylinder hole 1.1, and a synthetic resin layer 4.3 which abuts holding plate 3 and forms a watertight seal therewith, the head 2.4 being received in the bulge 4.1.

On the inner side of the door panel 1, a backing plate 5 is provided and is formed with a C-shaped slot 5.1 defining a pair of arms 5.2 which flank the shank 2.1 of lock cylinder 2. A synthetic resin layer 5.3 is provided on one surface of backing plate 5 and abuts the panel 1 to form a watertight seal therewith. An adhesive coating 5.4 can be applied on the layer 5.3 for aiding in the placement of the backing plate 5 on the panel 1.

The plates 3, 4 and 5 are formed respectively with bores 3.3, 4.4 and 5.5 which lie in mutual alignment with bores 1.2 formed in door panel 1 and which are traversed by blind rivets 6 which act to mount the lock/plate assembly on the door panel, the rivets 6 being shown before setting in FIG. 1 and after setting in FIG. 2.

Figure 3:
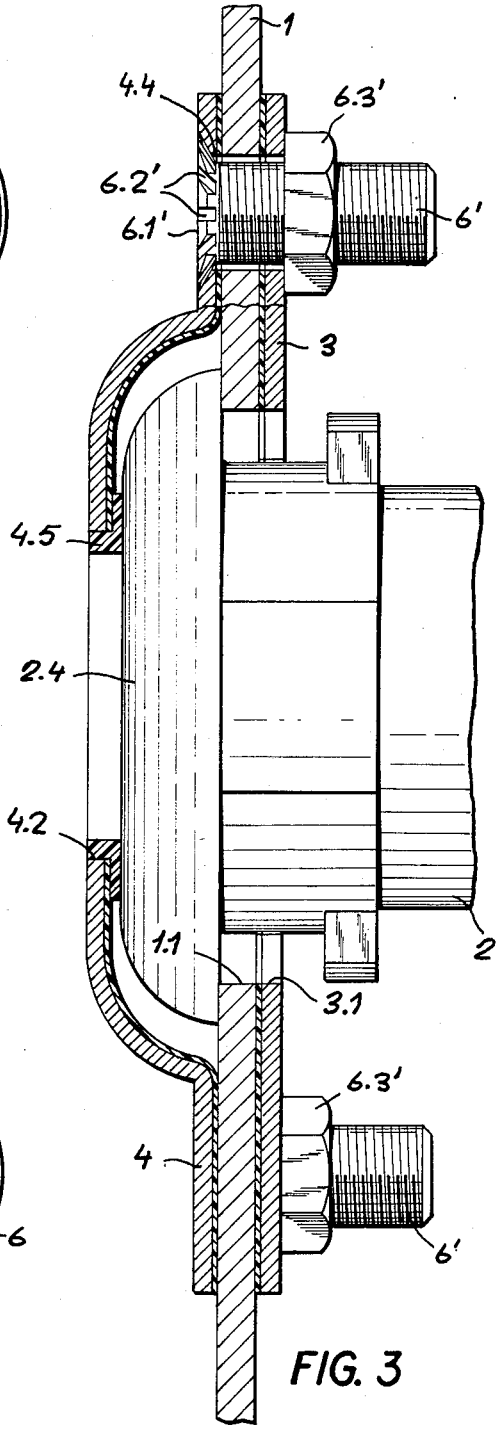
FIG. 3 is a sectional view similar to that of FIG. 2 showing another feature of the invention.

Further features of the invention are shown in FIG. 3 in which the backing plate 5 has been eliminated and the holding plate 3 is positioned on the inner side of the door panel 1 and the cover plate 4 lies directly on the outer side of the panel 1.

The keyhole 4.2 of the cover plate 4 is here provided with a synthetic resin grommet 4.5 which bears on the cylinder head 2.4 to form a watertight seal therewith. Another feature includes a nut and bolt assembly used for mounting the lock/plate assembly, in which the bolt 6' has a countersunk head 6.1' formed with ribs 6.2' and is press fitted into the bore 4.4 whereby the head 6.1' becomes embedded in the cover plate 4 and lies flush with the outwardly facing surface thereof, while the ribs 6.2' prevent any rotation of the bolt 6' when the nut 6.3' is tightened.

Figure 4:
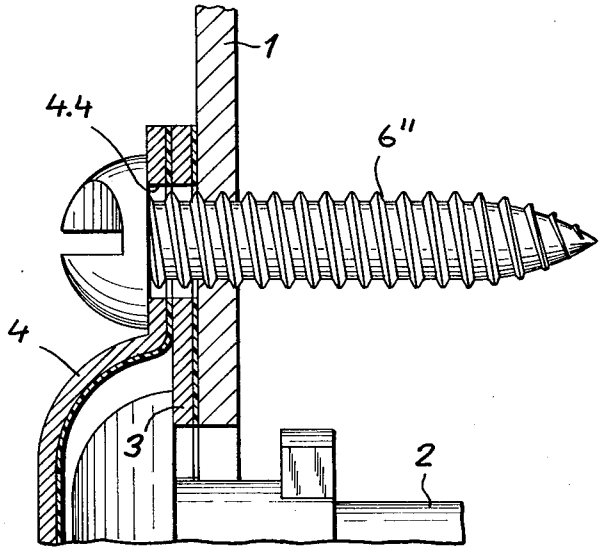
FIG. 4 is a partial sectional view similar to that of FIG. 3 showing a further feature of the invention.

In another feature of the invention shown in FIG. 4, in which both the cover plate and holding plate are to be mounted on the outer side of the door panel and the backing plate is to be eliminated, one-way self-tapping screws 6" are used and threadedly engage the door panel 1 to mount the lock/plate assembly thereon.

Figure 5:
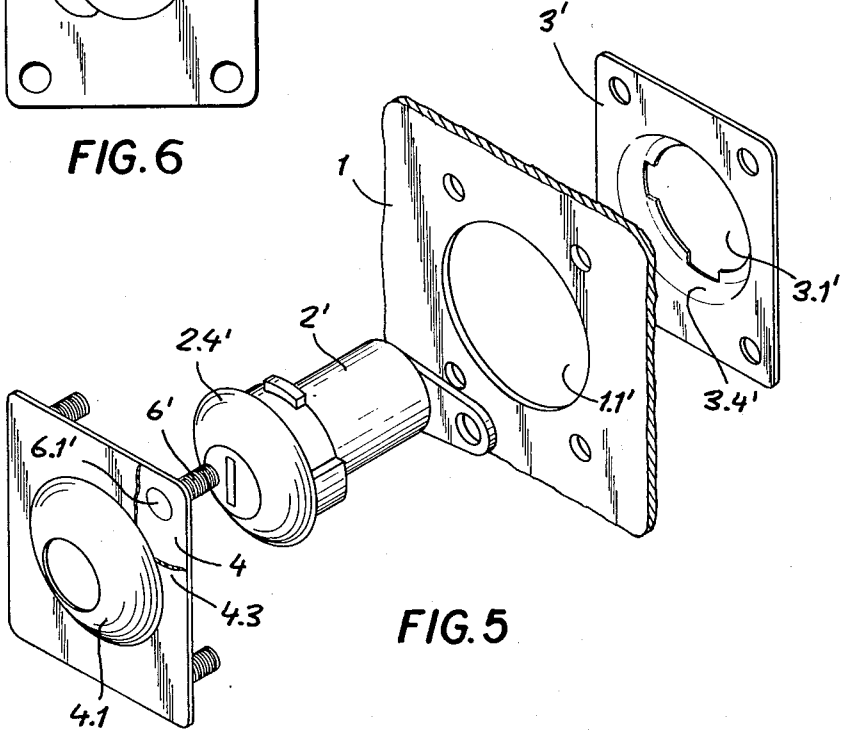
FIG. 5 is an exploded perspective view similar to FIG. 1 showing another embodiment of the invention.

In another embodiment of the invention shown in FIG. 5, in which it is desired to use a lock cylinder 2' having an extra thick head 2.4', the damaged cylinder hole 1.1' is trimmed to remove all fracture lines, leaving a hole large enough to accommodate the diameter of the head 2.4'. In order to accommodate the thickness of the head 2.4', a holding plate 3' is provided in which the notched opening 3.1' is formed in a bulge 3.4' similar to the bulge 4.1 of cover plate 4, and is mounted on the inner side of door panel 1, whereby the extra thick cylinder head 2.4' can be accommodated between the bulges 4.1 and 3.4'. Further, the cover plate 4 can be mounted using the bolts 6' and the countersunk heads 6.1' thereof can be hidden from view by a decorative foil overlay 4.3 applied to the outwardly facing surface of the cover plate 4.

Figure 6:
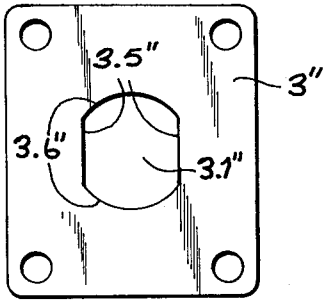
FIG. 6 is a front elevational view of a holding plate according to a further embodiment of the invention.

FIG. 6 illustrates a further embodiment of a holding plate 3" having an opening 3.1" formed by a pair of spaced parallel flats 3.5" joined at their ends by arcs 3.6", this type of holding plate being used in mounting lock cylinders of the type which act as electrical switches for operating electric garage doors and the like.

We claim:

1. A lock plate assembly adapted to be mounted on a supporting surface formed with a cylinder hole, said assembly comprising:

a cover plate provided with a bulge, said bulge having a keyhole formed in registration with said cylinder hole;

a lock cylinder having a shank with a noncircular outline disposed in said cylinder hole and a head disposed in said bulge;

a holding plate formed with a noncircular opening in registration with said cylinder hole and complementary to said noncircular shank outline and in engagement therewith for preventing rotation of said lock cylinder;

a plurality of bores formed in respective mutual alignment in said cover plate, said supporting surface, and said holding plate; and respective fastening means traversing the aligned bores for mounting said lock plate assembly on said supporting surface with at least said cover plate on an outer side thereof.

2. The lock plate assembly defined in claim 1 wherein said holding plate is mounted on said outer side of said supporting surface.

3. The lock plate assembly defined in claim 2, further comprising a backing plate disposed on an inner side of said supporting surface and formed with a C-shaped slot defining a pair of arms for flanking said shank, said backing plate having a plurality of bores formed in respective mutual alignment with said aligned bores and traversed by said fastening means for mounting said backing plate on said supporting surface.

4. The lock plate assembly defined in claim 3 wherein said backing plate is provided with a synthetic resin layer on a surface of said backing plate facing said supporting surface for forming a watertight seal therewith.

5. The lock plate assembly defined in claim 1 wherein said holding plate is provided with a synthetic resin layer on a surface thereof facing said supporting surface for forming a watertight seal therewith, and said cover plate is provided with a synthetic resin layer on a surface thereof facing said holding plate for forming a watertight seal therewith.

6. The lock plate assembly defined in claim 1 wherein said holding plate is mounted on an inner side of said supporting surface.

7. The lock plate assembly defined in claim 6 wherein said cover plate is provided with a synthetic resin layer on a surface thereof facing said supporting surface for forming a watertight seal therewith, and said mounting is provided with a synthetic resin layer on a surface thereof facing said supporting surface for forming a watertight seal therewith.

8. The lock plate assembly defined in claim 6 wherein said holding plate is provided with a bulge, and said noncircular opening is formed in said bulge.

9. The lock plate assembly defined in claim 8 wherein said cover plate is provided with a synthetic resin layer on a surface thereof facing said supporting surface for forming a watertight seal therewith, and said holding plate is provided with a synthetic resin layer on a surface thereof facing said supporting surface for forming a watertight seal therewith.

10. The lock plate assembly defined in claim 1 wherein said keyhole is provided with a synthetic resin grommet bearing against the head of said lock cylinder for forming a watertight seal therewith.

11. The lock plate assembly defined in claim 1 wherein said fastening means is a blind rivet inserted from the cover plate side of said assembly.

12. The lock plate assembly defined in claim 1 wherein said fastening means is a nut and bolt assembly, said bolt having a head embedded in said cover plate.

13. The lock plate assembly defined in claim 1 wherein said fastening means is a one-way self-tapping screw inserted from the cover plate side of said assembly and threadedly engaging said supporting surface.

14. The lock plate assembly defined in claim 1 wherein the noncircular opening of said holding plate is formed by a pair of spaced parallel flats joined by arcuate ends.

15. The lock plate assembly defined in claim 14 wherein said holding plate is provided with a synthetic resin layer on a surface thereof facing said supporting surface for forming a watertight seal therewith.

16. The lock plate assembly defined in claim 1 wherein said supporting surface is a car door panel.

17. The lock plate assembly defined in claim 1 wherein the noncircular opening of said holding plate is formed by a plurality of notches joined by arcs.

18. The lock plate assembly defined in claim 1 wherein a decorative overlay is applied to an outer surface of said cover plate after mounting thereof for covering said fastening means.

19. The lock plate assembly defined in claim 1 wherein an adhesive coating is provided on a surface of at least one of said plates contacting said supporting surface for aiding in the placement of said one plate thereon.

20. The lock plate assembly defined in claim 1 wherein at least one of said plates is composed of stainless steel.

* * * * *